US005774763A

United States Patent [19]

Muramatsu

[11] Patent Number: 5,774,763

[45] Date of Patent: Jun. 30, 1998

[54] ENERGY EFFICIENT FIXING DEVICE HAVING A FAST RESPONSE

[75] Inventor: Shigeru Muramatsu, Yokohama, Japan

[73] Assignee: Ricoh Company, Ltd., Tokyo, Japan

[21] Appl. No.: 893,983

[22] Filed: Jul. 16, 1997

Related U.S. Application Data

[63] Continuation of Ser. No. 568,513, Dec. 7, 1995, abandoned.

[30] Foreign Application Priority Data

| | | | |
|---|---|---|---|
| Dec. 13, 1994 | [JP] | Japan | 6-309097 |
| Jul. 13, 1995 | [JP] | Japan | 7-176988 |
| Nov. 22, 1995 | [JP] | Japan | 7-304383 |

[51] Int. Cl.[6] ..... G03G 15/20

[52] U.S. Cl. ..... 399/69; 219/216; 399/45; 399/70; 399/328; 399/336; 432/60

[58] Field of Search ..... 399/68, 67, 328, 399/330, 336, 69, 70, 45; 219/216, 469, 470, 490; 432/59, 60; 430/124

[56] References Cited

U.S. PATENT DOCUMENTS

| | | | |
|---|---|---|---|
| 3,452,181 | 6/1969 | Stryjewski | 219/216 |
| 4,163,892 | 8/1979 | Komatsu et al. | 219/216 |
| 4,435,069 | 3/1984 | Sato | 219/216 X |
| 4,796,048 | 1/1989 | Bean | 399/336 X |
| 5,286,948 | 2/1994 | Landa et al. | 219/216 |
| 5,319,428 | 6/1994 | Maruko et al. | 355/290 |
| 5,359,401 | 10/1994 | Uehara et al. | 355/285 |
| 5,414,496 | 5/1995 | Obata | 355/210 |
| 5,481,349 | 1/1996 | Satoh et al. | 355/290 |
| 5,486,903 | 1/1996 | Kanno et al. | 355/208 |
| 5,512,992 | 4/1996 | Kim et al. | 355/285 |
| 5,512,993 | 4/1996 | Endo et al. | 355/285 |
| 5,521,676 | 5/1996 | Furushima | 355/208 |
| 5,550,637 | 8/1996 | Murakami | 355/208 |
| 5,568,229 | 10/1996 | Szlucha | 355/208 |
| 5,602,635 | 2/1997 | Domoto et al. | 399/328 |

FOREIGN PATENT DOCUMENTS

| | | |
|---|---|---|
| 56-72470 | 6/1981 | Japan . |
| 58-217978 | 12/1983 | Japan . |
| 60-22163 | 2/1985 | Japan . |
| 60-178852 U | 11/1985 | Japan . |
| 64-32567 U | 3/1989 | Japan . |
| 64-54071 U | 4/1989 | Japan . |
| 6-258975 | 9/1994 | Japan . |

*Primary Examiner*—Arthur T. Grimley
*Assistant Examiner*—Sophia S. Chen
*Attorney, Agent, or Firm*—Oblon, Spivak, McClelland, Maier & Neustadt, P.C.

[57] ABSTRACT

In an image forming apparatus, a fixing device has a structure in which a film formed on an outer face of a hollow cylinder is heated by a heat ray of a heater. In this structure, the heating response time of the fixing device is improved. The image forming apparatus generates one or more conditions having influence on a fixing operation and corresponding to a printing paper sheet. The operation of the fixing device is controlled in accordance with the one or more conditions. Since there is one or more conditions of the printing paper sheet for controlling the fixing operation, fixing processing can be preferably executed even when various kinds of factors of the printing paper sheet such as a size, a conveying direction, etc. are different from each other. The heating response time of the fixing device is preferable so that temperature control of the fixing device can be effectively executed. The fixing processing can be preferably executed so as to provide fast heating and energy savings even when sizes, conveying directions of the printing paper sheet, etc. are respectively different from each other.

38 Claims, 8 Drawing Sheets

ENERGY EFFICIENT FIXING DEVICE HAVING A FAST RESPONSE

This application is a continuation of application Ser. No. 08/568,513 filed on Dec. 7, 1995, now abandoned.

BACKGROUND OF THE INVENTION

1. Field of the Invention

The present invention relates to an image forming apparatus in which toner is transferred to a sheet of printing paper by an electrophotographic mechanism and is fixed to this paper sheet by a fixing means.

2. Description of the Related Art

Various kinds of image forming apparatuses utilizing an electrophotographic method spread as a laser printer, a digital copying machine, etc. at the present time. In such image forming apparatuses, there is a well-known image forming apparatus (1) in which a sheet of printing paper is fed by a feeding means and toner is transferred onto this printing paper sheet by an electrophotographic mechanism. In this image forming apparatus, this printing paper sheet is heated and pressurized by a fixing means so that the toner is fixed onto the printing paper sheet. An image forming apparatus described in each of Japanese Utility Model Application Laying Open (KOKAI) Nos. 64-32567 and 64-54071 is proposed as such an image forming apparatus to improve heating efficiency. FIG. 1 shows a fixing means of this image forming apparatus. In FIG. 1, the fixing means has a hollow cylinder 19, a heater 21 arranged within this hollow cylinder 19 and radiating a heat ray, and a press contact feeding member 18 for making a sheet 8 of printing paper come in press contact with the hollow cylinder 19 and feeding the printing paper sheet 8. A reflecting plate 22 is arranged within the hollow cylinder 19. The heat ray generated by the heater 21 is reflected on this reflecting plate 22 onto a side of the press contact feeding member 18.

In addition to the image forming apparatus described in the above (1), there is another well-known image forming apparatus (2) in which various kinds of printing paper sheets are selectively fed by a selective feeding means and toner is transferred onto a selected printing paper sheet by an electrophotographic mechanism. This printing paper sheet is then heated and pressurized by a fixing means so that the toner is fixed onto the printing paper sheet. In this image forming apparatus, power consumption of this fixing means is reduced at a standby time of image formation. In such an image forming apparatus, it takes time until the fixing means generates heat at a high temperature required to fix the toner onto the printing paper sheet from an ordinary temperature. Accordingly, it is necessary to supply electric power to the fixing means at the standby time so as to rapidly start the fixing operation. However, in this case, power consumption of a fixing device is uselessly increased. Therefore, a reduction in power consumption at the standby time within an allowable range of a starting time of heating of the fixing device spreads at the present time.

In the image forming apparatus described in the above (1), the heat ray is directly emitted to the printing paper sheet 8. Therefore, there is a case in which the printing paper sheet 8 burns when there is an error in control of a turning-on operation and a turning-off operation of the heater 21 or a paper jam is caused. Further, the hollow cylinder 21 is formed by a heat ray transmitting material so that no heat is accumulated in the hollow cylinder 21. Therefore, energy efficiency of the hollow cylinder 21 is low so that high electric power is required for the hollow cylinder 21.

In the image forming apparatus described in the above (2), power consumption of the fixing device is reduced at the standby time so that a heating temperature of the fixing device is lowered. Therefore, it takes time to set the temperature of the fixing device to a high temperature. Accordingly, driving power must be applied to the fixing device at a starting time of the image forming apparatus slightly before the printing paper sheet is fed. Further, in reality, there are problems of a defect in fixing and generation of excessive heat even when the driving power is applied to the fixing device and the temperature of the fixing device is increased to a fixing temperature required for the fixing operation at the fixing time. This is because the image forming apparatus selectively feeds printing paper sheets in plural kinds of different conditions as mentioned above so that each of these various kinds of conditions with respect to the printing paper sheets has influence on the fixing operation of the fixing device.

The following first and second systems are proposed to prevent such problems from being caused.

(i) In the first system, a transversal width of the printing paper sheet perpendicular to its feeding direction is detected as in an image forming apparatus shown in Japanese Patent Application Laying Open (KOKAI) No. 56-72470. Set temperatures of the fixing means are switched by controlling an electric current supplied to the fixing means in accordance with this detected transversal width.

(ii) In the second system, the fixing means has plural fixing heaters as in an image forming apparatus shown in Japanese Patent Application Laying Open (KOKAI) No. 60-22163. The number of driven fixing heaters is switched in accordance with a thickness of the printing paper sheet. However, in the image forming apparatuses of these first and second systems, it is impossible to prevent the defect in fixing and the generation of excessive heat so as to solve the above problems and satisfy the above requirements.

SUMMARY OF THE INVENTION

It is therefore an object of the present invention to provide an image forming apparatus for solving the problems of the image forming apparatus described in the above (1) in which no transfer paper sheet burns when there is an error in control of a turning-on operation and a turning-off operation of a heater and a paper jam is caused, and heat is accumulated in a fixing means so that the fixing means has preferable energy efficiency and a quick heating response time.

Another object of the present invention is to provide an image forming apparatus for solving the problems of the image forming apparatus described in the above (2) and having a fixing means capable of preventing a defect in fixing and generation of excessive heat so as to satisfy requirements for various kinds of printing paper sheets selectively fed in different conditions.

In accordance with a first construction of the present invention, the above objects can be achieved by an image forming apparatus in which a sheet of printing paper is fed by a feeding mechanism and toner is transferred to this printing paper sheet by an electrophotographic mechanism and is fixed to the printing paper sheet by heating and pressurizing the printing paper sheet by fixing means;

the fixing means having:

a hollow cylinder having a single film formed on an outer circumferential face thereof such that the single film absorbs a heat ray and is heated and has a mold-releasing property and the heat ray is transmitted through the hollow cylinder;

a heater arranged within this hollow cylinder and radiating the heat ray; and a press contact feeding member for feeding the printing paper sheet in a state in which the printing paper sheet comes in press contact with the hollow cylinder. Accordingly, the heat ray of the heater heats only the thin film so that thermal efficiency of the heater is improved. Further, a quick heating response time to this heating is preferable so that no preliminary heating at a standby time is required or only a small heating amount is required. Accordingly, a fixing operation can be performed by a small heating amount without any waiting time.

In accordance with a second construction of the present invention, the film covering the outer circumferential face of the hollow cylinder approximately has a black color having a high heat ray absorbing property. Accordingly, a heat absorbing speed of the thin film is increased so that the fixing operation can be performed by a smaller heating amount without any waiting time.

In accordance with a third construction of the present invention, the heat ray of the heater is concentrated to the hollow cylinder on a feeding side of the printing paper sheet in the vicinity of a nipping portion between the hollow cylinder and the press contact feeding member. Accordingly, heat of the heater is concentrated onto an inlet side of the nipping portion. Thus, useless heat radiation is prevented before a fixing process. Further, heating efficiency and heating speed can be preferably increased by concentrating this heat to the thin film.

In accordance with a fourth construction of the present invention, an input portion of the heater has a copy standby mode for preliminarily heating the hollow cylinder with low power and a high power heating mode at a copying time. Accordingly, electric power of the heater can be saved and the fixing operation can be further performed without any waiting time since the input portion of the heater has the copy standby mode for preliminarily heating a portion of a fixing roller with low power and the high power heating mode at the copying time.

In accordance with a fifth construction of the present invention, the above objects can be also achieved by an image forming apparatus in which plural kinds of printing paper sheets are selectively fed by selective feeding means;

toner is transferred to a selected printing paper sheet by an electrophotographic mechanism and is fixed to this printing paper sheet by heating and pressurizing the printing paper sheet by fixing means; and power consumption of this fixing means is reduced at a standby time of image formation;

the fixing means having:

a hollow cylinder having a film formed on an outer circumferential face thereof such that the film absorbs a heat ray and is heated and the heat ray is transmitted through the hollow cylinder;

a heater arranged within this hollow cylinder and radiating the heat ray; and a press contact feeding member for feeding the printing paper sheet in a state in which the printing paper sheet comes in press contact with the hollow cylinder;

the image forming apparatus comprising:

condition generating means for generating one or more conditions having influence on an operation of the fixing means in accordance with the printing paper sheet fed by the selective feeding means; and operation control means for controlling the operation of the fixing means in accordance with the generated one or more conditions. When the printing paper sheet comes in press contact with the hollow cylinder and is fed by the press contact feeding member and the condition generating means generates one or more conditions having influence on the operation of the fixing means in accordance with the printing paper sheet fed by the selective feeding means, the operation control means controls the operation of the fixing means in accordance with the generated one or more conditions. Plural factors such as a size and a conveying direction of the printing paper sheet, etc. have influence on the operation of the fixing means. Since the operation of the fixing means is controlled in accordance with the one or more conditions, several kinds of printing paper sheets are preferably fixed by this fixing means.

In accordance with a sixth construction of the present invention, the operation control means switches starting timing of an operation of the heater of the fixing means. Accordingly, an accumulating amount of heat of a roller for fixing the printing paper sheet is switched by switching starting timing of the operation of the heater of the fixing means by the operation control means.

In accordance with a seventh construction of the present invention, the operation control means switches electric power for operating the heater of the fixing means. Accordingly, a heating temperature of the heater for fixing the printing paper sheet is switched by switching electric power for operating the heater of the fixing means by the operation control means.

In accordance with an eighth construction of the present invention, the condition generating means generates at least one of a size, a conveying direction and a thickness of the printing paper sheet as the one or more conditions. Accordingly, the operation of the fixing means can be controlled in accordance with one condition of the printing paper sheet or a combination of plural conditions of the printing paper sheet since the condition generating means generates at least one of a size, a conveying direction and a thickness of the printing paper sheet as the above one or more conditions.

Further objects and advantages of the present invention will be apparent from the following description of the preferred embodiments of the present invention as illustrated in the accompanying drawings.

DESCRIPTION OF THE PREFERRED EMBODIMENTS

The preferred embodiments of an image forming apparatus in the present invention will next be described in detail with reference to the accompanying drawings.

Figure 1:
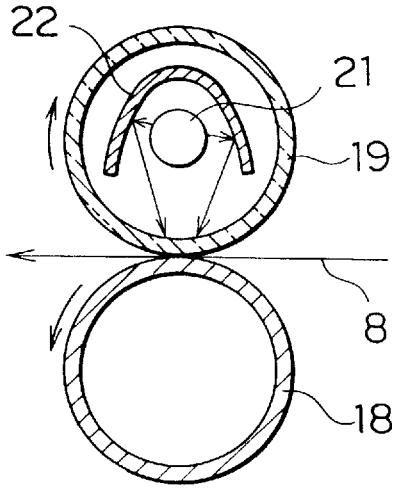
FIG. 1 is a longitudinal sectional view showing the internal structure of a general fixing means of the same kind as the present invention.
Figure 2:
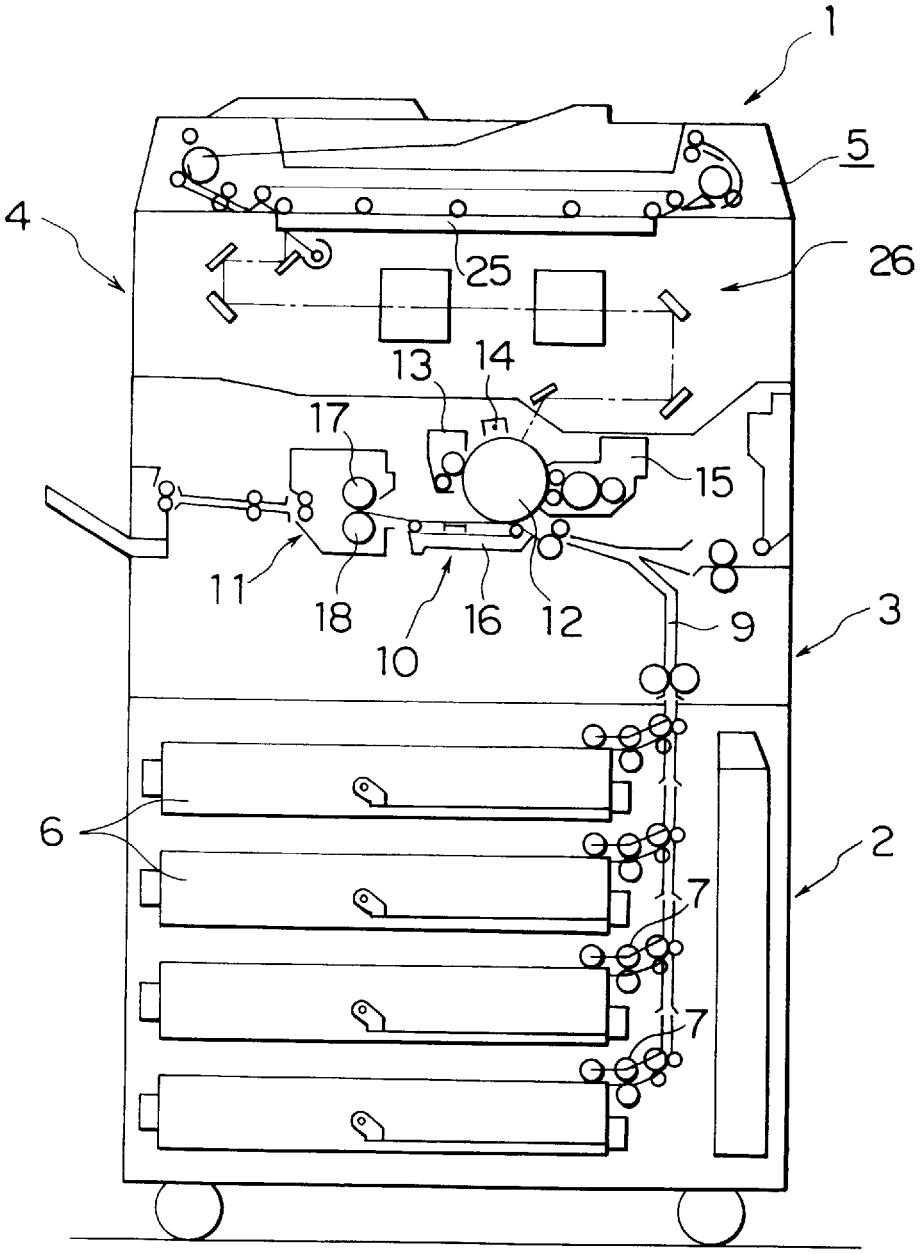
FIG. 2 is a longitudinal sectional view showing the internal structure of a copying machine having an image forming apparatus in the present invention.

FIG. 2 shows a copying machine 1 having an image forming apparatus of the present invention. This copying machine 1 has a selective feeding means 2, an image printing means 3, an image scanning means 4 and an original feeding means 5.

A plurality of paper feeding cassettes 6 are arranged in the selective feeding means 2. A separate feeding member 7 is arranged such that the separate feeding member 7 is opposed to each of these paper feeding cassettes 5. A sheet 8 of printing paper is sequentially fed from such a paper feeding means 2 to the image printing means 3. A paper conveying path 9 for sequentially feeding the printing paper sheet 8 is formed in the image printing means 3. An electrophotographic mechanism 10 and a fixing means 11 are sequentially arranged in this paper conveying path 9.

An unillustrated operation panel is arranged on a front face of the image printing means 3. A size and a conveying direction of the printing paper sheet 8 are inputted to this operation panel as various kinds of information relative to a copying operation. An unillustrated paper thickness detecting sensor for detecting a thickness of the printing paper sheet 8 and an unillustrated dip switch are arranged in the selective feeding means 2, etc.

The electrophotographic mechanism 10 has a photosensitive drum 12 located on the paper conveying path 9. A toner cleaner 13, a charger 14, a developing device 15, a transfer belt 16, etc. are arranged around the photosensitive drum 12.

Figure 4:
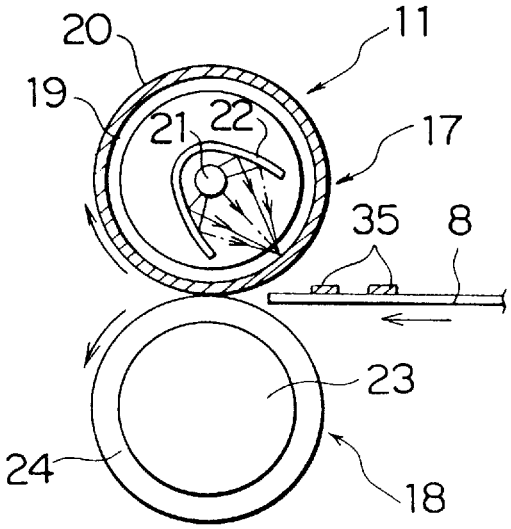
FIG. 4 is a longitudinal sectional view showing an internal structure of the fixing means this image forming apparatus.

The fixing means 11 has a heating roller 17 and a press contact feeding member 18 constructed by a pressurizing roller. The heating roller 17 and the press contact feeding member 18 come in press contact with each other through the paper conveying path 9. The press contact feeding member 18 has a metallic cylinder 23 (see FIG. 4). An outer sheath 24 such as silicon rubber having preferable heat resistance and elasticity is formed in this metallic cylinder 23. A pressurizing belt may be used as the press contact feeding member 18 instead of the pressurizing roller. As shown in FIG. 4, for example, the heating roller 17 has a hollow cylinder 19 made of quartz glass through which a heat ray is transmitted. When this hollow cylinder 19 is formed by quartz glass having heat resistance and constituting a heat ray transmitting material, the hollow cylinder 19 has a thickness such as about 3 mm capable of bearing a fixing pressure. However, the hollow cylinder 19 may have a thickness except for 3 mm suitably selected in accordance with a diameter of the hollow cylinder and a pressure applied to this hollow cylinder.

For example, a film 20 having a thickness from several microns to about 1 mm is formed on an outer circumferential face of the hollow cylinder 19 by a material made of polytetrafluoroethylene commonly sold under the trademark TEFLON™, fluorine or silicon having a preferable mold-releasing property and heat resistance. This film 20 has preferable a fast heating response time during fixing because the film 20 becomes thin. The film 20 normally having a thickness from several microns to about 1 mm is preferably black approximately. A heat ray absorbing property of the film 20 is preferable as the color of the film 20 approaches a pitch-black color. An infrared heater 21 for radiating an infrared ray as a heat ray is arranged within the hollow cylinder 19. A reflecting plate 22 for converging the infrared ray to the film 20 is arranged such that this reflecting plate 22 is opposed to the infrared heater 21. No reflecting plate 22 may be arranged when no reflecting plate 22 is required. In this case, the infrared heater 21 is arranged such that this infrared heater 21 approaches a converging point of the film 20.

The image scanning means 4 has a contact glass 25. A scanning optical system 26 is arranged below this contact glass 25. This scanning optical system 26 optically scans an image of an unillustrated reading original arranged on a surface of the contact glass 25. This image is incident to the photosensitive drum 12 of the image printing means 3 by the scanning optical system 26.

Figure 3:
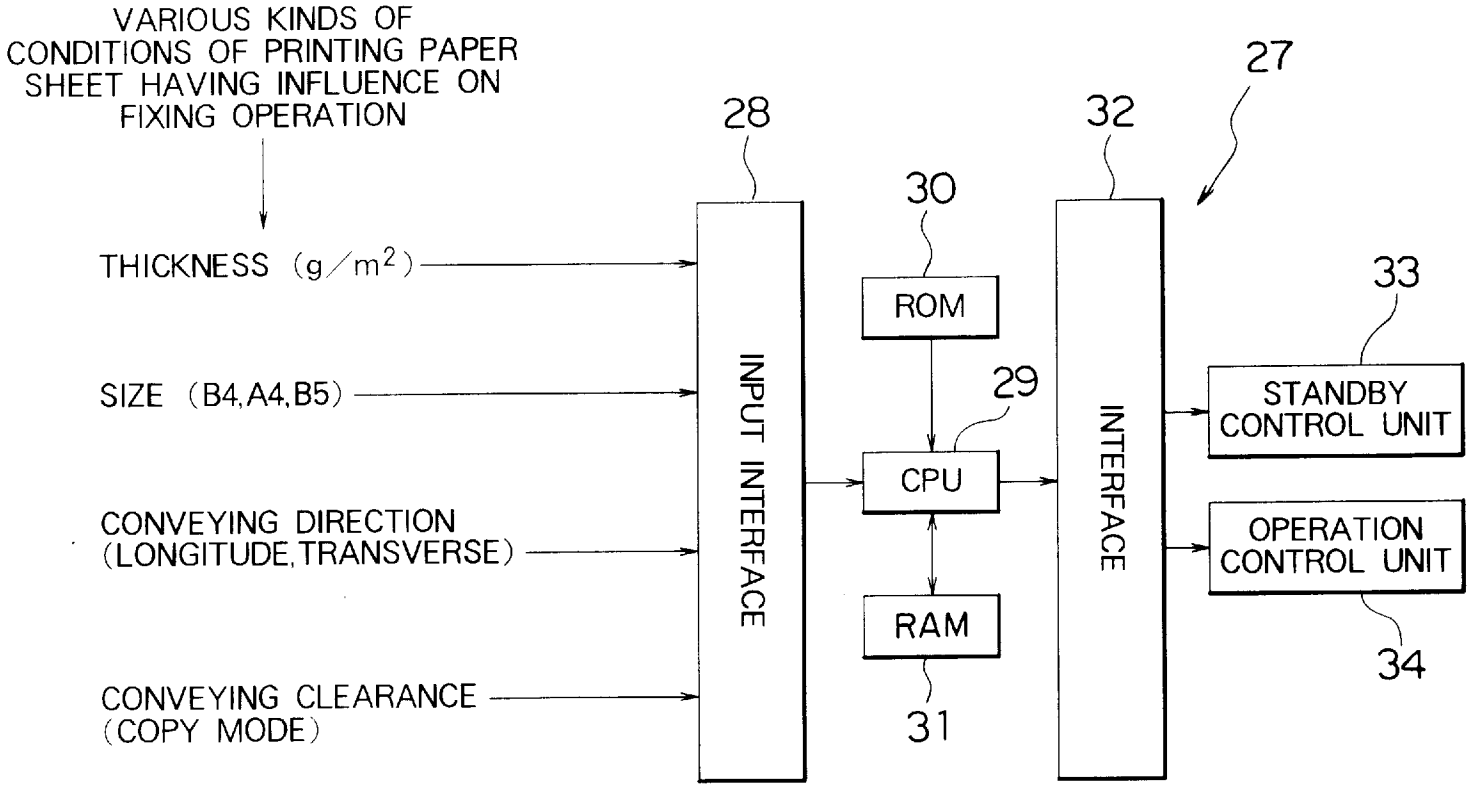
FIG. 3 is a block diagram showing an embodiment form of a circuit structure for control of a fixing means arranged in the image forming apparatus shown in FIG. 2.

FIG. 3 shows a fixing control circuit 27 for controlling an operation of the fixing means 11. The above operation panel, the paper thickness detecting sensor and the dip switch are connected to this fixing control circuit 27. In this fixing control circuit 27, a CPU 29 is connected to an input I/F 28 and is also connected to a ROM 30, a RAM 31 and an output I/F 32. This output I/F 32 is connected to a standby control unit 33 and an operation control unit 34. These control units 33 and 34 are connected to the fixing means 11.

Programs, parameters, etc. required to control the operation of the fixing means 11 are fixedly stored to the ROM 30 in advance. The CPU 29 outputs control data of the operation of the fixing means 11 to the output I/F 32 by using a memory region of the RAM 31, etc. on the basis of input data of the input I/F 28 and stored data of the ROM 30. These control data are inputted to the control units 33 and 34 so that these control units 33 and 34 control the operation of the fixing means 11 in accordance with the control data.

The copying machine 1 has a condition generating means and an operation control means. The condition generating means has the above operation panel, the paper thickness detecting sensor and the dip switch. The condition generating means generates one or more conditions having influence on the operation of the fixing means 11 in accordance with a kind of the printing paper sheet 8 fed by the selective feeding means 2. More particularly, the condition generating means generates a size, a conveying direction, a thickness and a feeding clearance of the printing paper sheet 8, etc. as one or more conditions.

The above operation control means has the fixing control circuit 27 and controls the operation of the fixing means 11 by the control units 33 and 34 in accordance with the one or more conditions generated as above. In this control operation, starting timings of an operation of the infrared heater 21 are switched and are precedently set when it is difficult to perform the fixing operation.

In such a construction, the copying machine 1 can copy an image of the reading original to the printing paper sheet. In such a case, the reading original is set onto the original feeding means 4 and various kinds of information in a copying operation are inputted by the operation panel. For example, such inputted information are constructed by a size and a conveying direction of the printing paper sheet 8, the number of copies, a copying magnification, etc. When such information are completely set, starting of the copying operation is inputted.

Thus, the printing paper sheet 8 is sequentially fed from the selective feeding means 2 to the image printing means 3. This image printing means 3 feeds the printing paper sheet 8 to the electrophotographic mechanism 10. At this time, the image of the reading original fed onto a surface of the contact glass 25 by the original feeding means 5 is exposed to the photosensitive drum 12 of the electrophotographic mechanism 10 of the image printing means 3 by the image scanning means 4. Accordingly, an electrostatic latent image of this photosensitive drum 12 is developed by toner 35 of the developing device 15 and is transferred onto the printing paper sheet 8 (see FIG. 4). The printing paper sheet 8 having the transferred toner 35 is fed to the fixing means 11 and comes in press contact with the heating roller 17 generating heat by the press contact feeding member 18. The toner 35 is fixed onto the printing paper sheet 8 by these pressurization and heating. The copying operation is completed by discharging this printing paper sheet 8 to the exterior of the copying machine.

In this case, the infrared heater 21 is turned on in synchronism with the printing paper sheet 8 reaching a nipping portion between the heating roller 17 and the press contact feeding member 18. Otherwise, the infrared heater 21 is turned on when an unillustrated sensor detects that the printing paper sheet 8 reaches a position near the nipping portion. The film 20 covering an outer circumferential face of the heating roller 17 is heated by a heat ray of the infrared heater 21. The printing paper sheet 8 is heated by this heated film 20. Further, the heat ray of the infrared heater 21 is reflected on the reflecting plate 22 and is converged to a surface layer of the heating roller 17 on a feeding side of the printing paper sheet 8 in the vicinity of the nipping portion between the heating roller 17 and the press contact feeding member 18.

In this copying machine 1, the standby control unit 33 supplies a small amount of electric power to the heating roller 17 of the fixing means 11 at a standby time. Accordingly, the heating roller 17 is heated in advance to a low temperature so that power consumption of the copying machine is reduced. The operation control unit 34 supplies a large amount of electric power to the heating roller 17 of the fixing means 11 at the above fixing time so that the heating roller 17 is heated to a high temperature. In this case, the heating roller 17 is rapidly heated at the fixing time by the preliminary heating at the standby time. This heating of the heating roller 17 at the fixing time is started before the printing paper sheet 8 is fed. Starting timing of the operation of the fixing means 11 is controlled by the operation control unit 34 in accordance with one or more conditions of the printing paper sheet 8.

Figure 5:
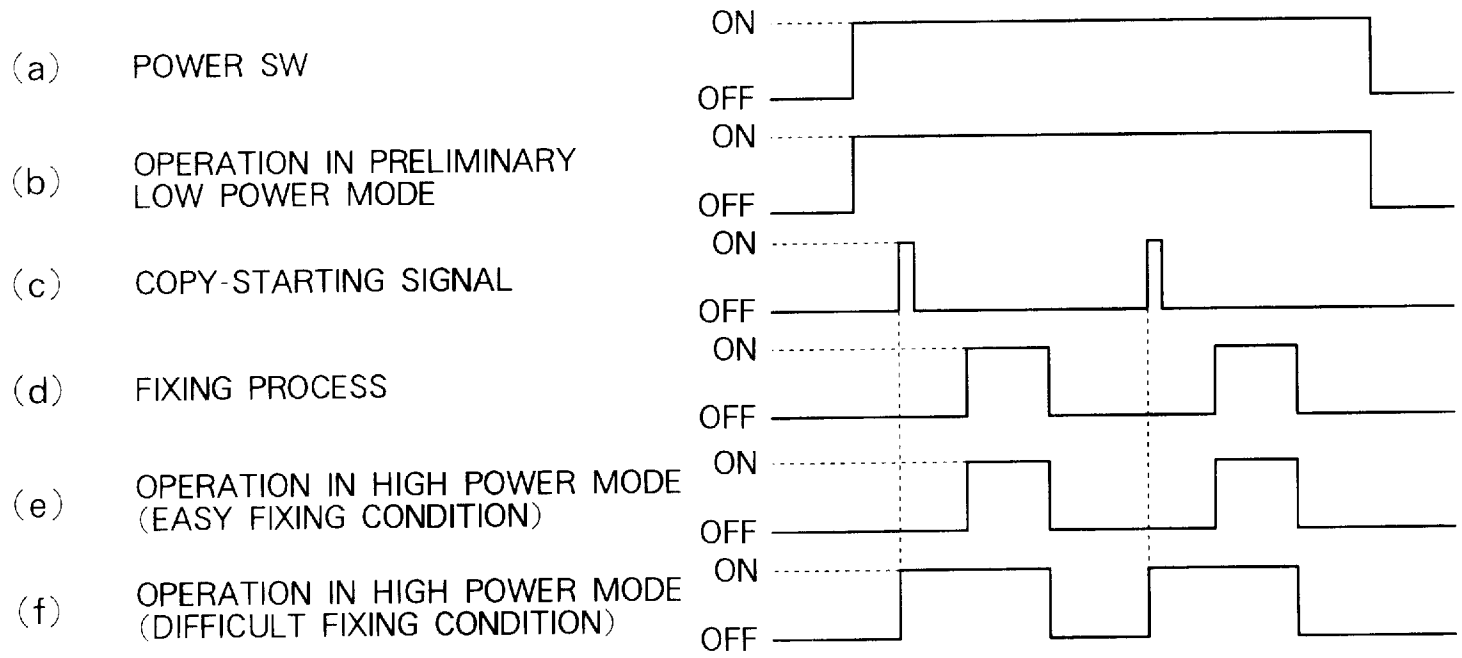
FIG. 5 is a timing chart showing operation timing of each of constructional portions of this image forming apparatus.

When the copying operation of the copying machine 1 is executed, a conveying direction and a size of the printing paper sheet 8 and operating contents of the copying machine are inputted to the operation panel. The paper thickness detecting sensor detects a thickness of the printing paper sheet 8. Such information is transmitted to the operation control unit 34 as one or more conditions having influence on the fixing operation. Accordingly, in this operation control means 34, the CPU 29 determines starting timing of the fixing operation in accordance with programs and parameters of the ROM 30. This timing is inputted to the operation control unit 34. Therefore, as shown in FIG. 5, this operation control unit 34 starts the operation of the fixing means 11 in accordance with the inputted timing. At this time, the infrared heater 21 is early turned on or a heating amount of the infrared heater 21 is increased when the printing paper sheet 8 is thick in a condition such as a thickness condition generated in the condition generating means.

In this case, when the operation of the fixing means 11 is precedently started, a heating time of the heating roller 17 is extended until arrival of the printing paper sheet 8. Accordingly, a surface layer temperature of the heating roller 17 and a surface layer temperature of the press contact feeding member 18 receiving heat from the surface layer of the heating roller 17 are raised. In contrast to this, when the starting of the operation of the fixing means 11 is delayed, the heating time of the heating roller 17 is shortened until the arrival of the printing paper sheet 8. Accordingly, a fixing temperature of the fixing means 11 is lowered. Such a fixing temperature is switched in accordance with one or more conditions of the printing paper sheet 8. Accordingly, the fixing operation of the printing paper sheet 8 can be preferably performed in consideration of various conditions.

When the fixing temperature of the fixing means 11 is controlled as mentioned above, the response time required to change the temperature of the heating roller 17 becomes a problem. However, the heating roller 17 heats the film 20 by an infrared ray radiated from the infrared heater 21. Accordingly, since a fast response time to change the temperature of the heating roller 17 is extremely preferable so that the fixing temperature of the fixing means 11 can be rapidly controlled. If this response time of the heating roller 17 is fast enough, it is not necessary to heat the fixing means 11 in advance at the standby time as mentioned above so that power consumption of the copying machine can be further reduced.

Figure 6:
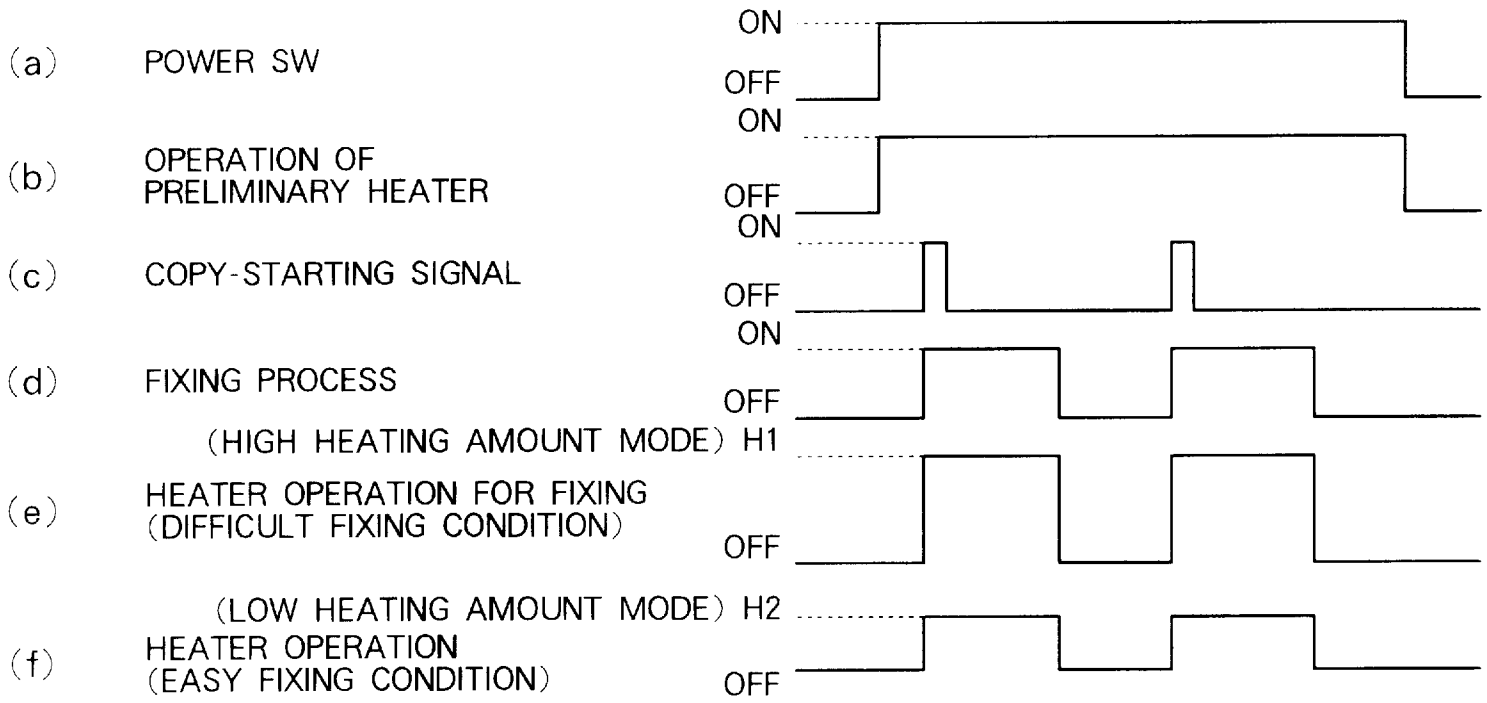
FIG. 6 is a timing chart showing operation timing of each of constructional portions of an image forming apparatus having a modified example of this fixing means.

As shown in FIG. 6, when the operation of the fixing means 11 is controlled by the operation control means in such a copying machine, driving power of the infrared heater 21 can be changed without changing the starting timing of the operation of the fixing means. Further, one or more conditions generated by the condition generating means are not limited to the above contents. For example, various kinds of factors having influence on the fixing operation can be used in these conditions.

Figure 7:
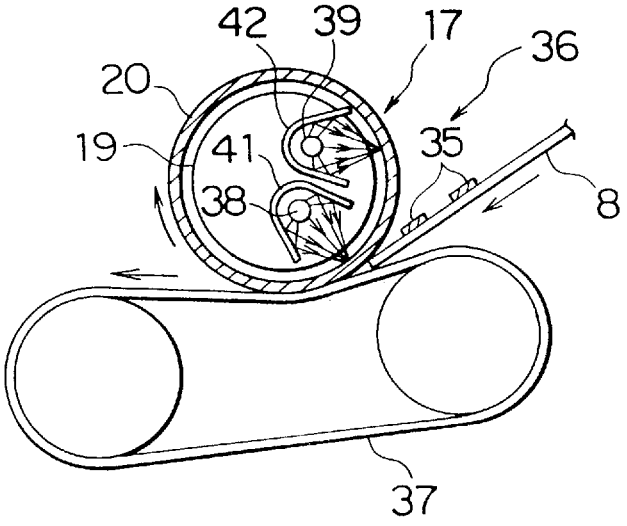
FIG. 7 is a longitudinal sectional view showing an internal structure of the modified example of the fixing means in the image forming apparatus shown in FIG. 6.

FIG. 7 shows a modified example 36 of the fixing means. The fixing means 11 and the fixing means 36 are different from each other as follows. Namely, the press contact feeding member 18 in the fixing means 11 is constructed by a pressurizing roller. In contrast to this, a press contact feeding member 37 in the fixing means 36 is constructed by a pressurizing belt instead of the pressurizing roller. Further, a sub-infrared heater 39 and a subreflecting plate 42 are arranged in addition to an infrared heater 38 and a reflecting plate 41. The pressurizing belt is formed by a high elastic material having heat resistance such as silicon rubber, etc. The press contact feeding member 37 may be constructed by a pressurizing roller instead of the pressurizing belt. Further, no reflecting plates 41 and 42 may be arranged if no reflecting plates 41 and 42 are required.

Figure 8:
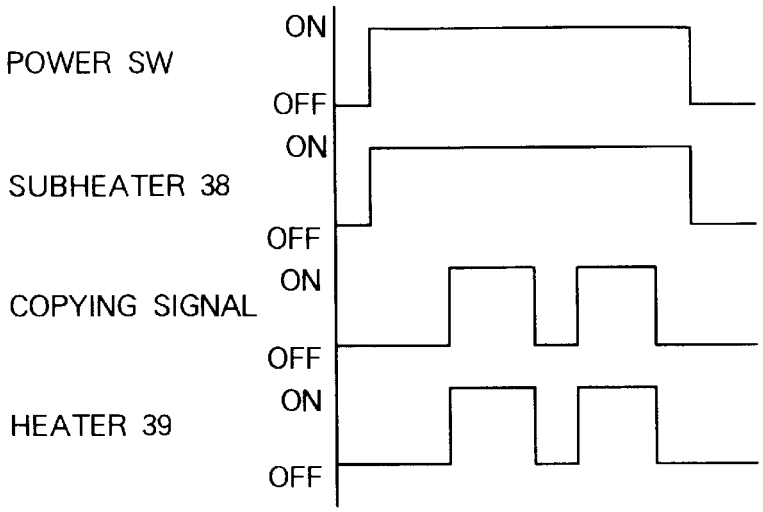
FIG. 8 is a timing chart showing different operation timings of the respective constructional portions of the image forming apparatus having the modified example of the fixing means.

FIG. 8 is an operation timing chart showing one example of operation timing of this fixing means 36. An unillustrated power switch and the sub-infrared heater 39 are operated in association with each other so that this power switch and the sub-infrared heater 39 are synchronously turned on and off. Thus, the hollow cylinder 19 of the heating roller 17 is also heated preliminarily at the time of a copy standby mode. The infrared heater 38 is turned on and off by turning a copying signal on and off in a high power heating mode at a copying time so that the fixing operation of the printing paper sheet 8 is performed. In this case, electric power supplied to the sub-infrared heater 39 is desirably low in view of saving of resources at the time of the copy standby mode. For example, electric power of about 100 W may be continuously supplied to the sub-infrared heater 39 in a range in which no heating roller 17 is excessively heated extraordinarily. Further, a turning-on operation and a turning-off operation of the sub-infrared heater 39 may be controlled by controlling a temperature of the sub-infrared heater 39.

Figure 9:
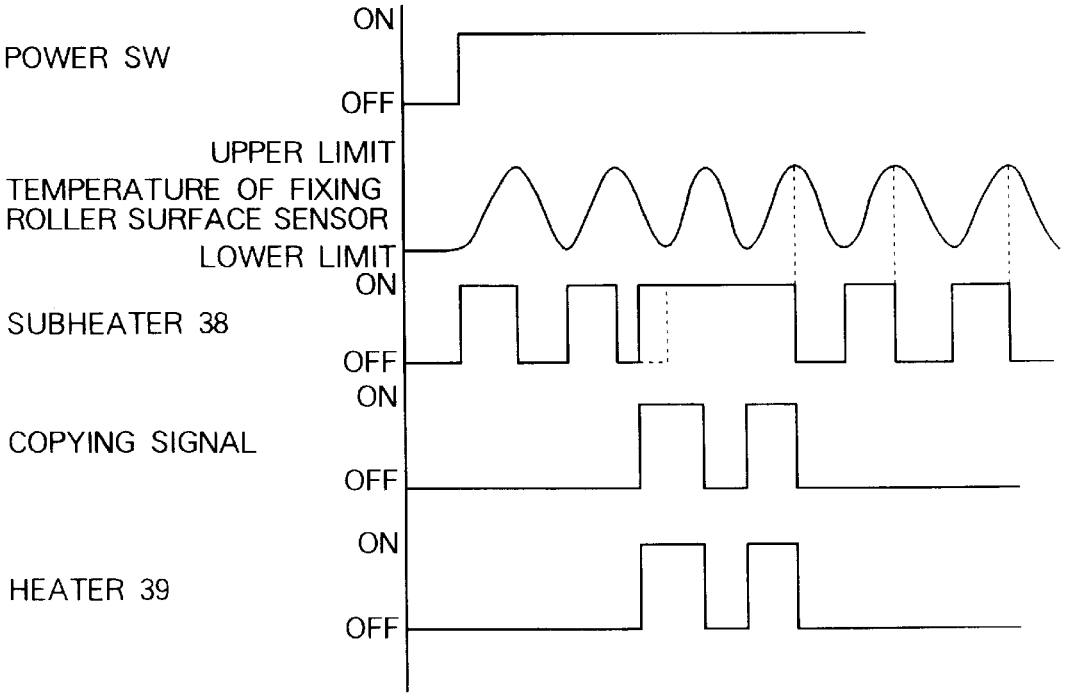
FIG. 9 is a timing chart showing another different operation timings of the respective constructional portions of the image forming apparatus having the modified example of the fixing means.

When the operation of the sub-infrared heater 39 is controlled as shown in FIG. 8, a surface of the heating roller 17 is extraordinarily heated by continuously turning on the sub-infrared heater 39. Accordingly, there is a fear of generation of a defect in fixing such as a high temperature offset phenomenon, etc. when the printing paper sheet 8 is thin. Therefore, the operation of the sub-infrared heater 39 is controlled to prevent such a defect from being caused. FIG. 9 is a timing chart of the operation of the sub-infrared heater 39 in this case. A surface temperature of the heating roller 17 is detected by a sensor and is fed back so that the sub-infrared heater 39 is turned on and off in accordance with lower and upper limits of the surface temperature. When a copying signal is turned on, this copying signal is preferentially treated in comparison with the detected surface temperature as shown in FIG. 9 so that the sub-infrared heater 39 is continuously turned on. In this case, heat energy of the infrared heater 38 is added to that of the sub-infrared heater 39 at a temperature finally required for the heating roller.

As mentioned above, in the first construction of the present invention, the hollow cylinder of the fixing means is formed by a heat ray transmitting material. An outer circumferential face of the hollow cylinder is covered with a single film having a heat ray absorbing property and a toner-releasing property. Accordingly, a heat ray of a heater heats only the film so that thermal efficiency of the heater is improved. Further, a quick response to this heating is preferable so that no preliminary heating at a standby time is required or only a small heating amount is required. Accordingly, the fixing operation can be performed by a small heating amount without any waiting time.

In the second construction of the present invention, the thin film covering the outer circumferential face of the hollow cylinder of the fixing means approximately has a black color having a high heat ray absorbing property. Accordingly, a heat absorbing speed of the thin film is increased so that the fixing operation can be performed by a smaller heating amount without any waiting time.

In the third construction of the present invention, a heat ray of the heater is concentrated to the hollow cylinder on a feeding side of the transfer paper sheet in the vicinity of a nipping portion between the hollow cylinder and the press contact feeding member. Accordingly, heat of the heater is concentrated onto an inlet side of the nipping portion. Thus, useless heat radiation is prevented before a fixing process. Further, heating efficiency and heating speed can be preferably increased by concentrating this heat to the thin film.

In the fourth construction of the present invention, an input portion of the heater has a copy standby mode for preliminarily heating the hollow cylinder of the fixing means with low power and a high power heating mode at a copying time. Accordingly, electric power of the heater can be saved and the fixing operation can be further performed without any waiting time. The fourth construction is particularly suitable for a copy in winter and a copy for a thick printing paper sheet.

In the fifth construction of the present invention, the fixing means has a hollow cylinder having a film formed on an outer circumferential face thereof such that the film absorbs a heat ray and is heated and the heat ray is transmitted through the hollow cylinder. The fixing means also has a heater arranged within this hollow cylinder and radiating the heat ray. The fixing means further has a press contact feeding member for feeding the printing paper sheet in a state in which the printing paper sheet comes in press contact with the hollow cylinder.

The image forming apparatus has condition generating means for generating one or more conditions having influence on an operation of the fixing means in accordance with the printing paper sheet fed by the selective feeding means. The image forming apparatus also has operation control means for controlling the operation of the fixing means in accordance with the generated one or more conditions. Therefore, the operation of the fixing means is controlled in accordance with one or more conditions of the printing paper sheet. Accordingly, the fixing processing can be preferably executed in a state in which sizes and conveying directions of the printing paper sheet are respectively different from each other. Since there is one or more conditions of the printing paper sheet for controlling the fixing operation, the fixing processing can be preferably executed even when various kinds of factors of the printing paper sheet such as a size, a conveying direction, etc. are different from each other. A fast heating response by the film is preferable so that the above-mentioned operation of the fixing means can be effectively executed.

In the sixth construction of the present invention, the operation control means switches starting timing of an operation of the heater of the fixing means. Accordingly, a heating temperature of the heater of the fixing means is switched by simple control before arrival of the printing paper sheet so that an accumulating amount of heat of a roller can be adjusted.

In the seventh construction of the present invention, the operation control means switches electric power for operating the heater of the fixing means. Accordingly, a heating temperature of the heater for fixing the printing paper sheet can be switched by simple control.

In the eighth construction of the present invention, the condition generating means generates at least one of a size, a conveying direction and a thickness of the printing paper sheet as the above one or more conditions. Accordingly, the operation of the fixing means can be controlled in accordance with one condition of the printing paper sheet or a combination of plural conditions of the printing paper sheet.

Many widely different embodiments of the present invention may be constructed without departing from the spirit and scope of the present invention. It should be understood that the present invention is not limited to the specific embodiments described in the specification, except as defined in the appended claims.

What is claimed is:

1. A fixing device which fixes toner carried on paper processed by an electrophotographic apparatus, comprising:

at least one radiant heat source providing heat ray;

a hollow cylinder arranged around the radiant source, said hollow cylinder being transparent to the heat ray;

a film covering an outer circumferential face of the hollow cylinder, said film having a heat ray absorbing property permitting the impinging heat ray transmitted by the cylinder to be absorbed to heat the film to a temperature sufficient to fix the toner;

a press contact feed member feeding the paper carrying the toner into pressing contact with the film during toner fixing by the heated film;

a heat ray concentrator operatively associated with the radiant heat source and surrounded by said hollow cylinder so as to concentrate the heat ray on an area of the film near to a nipping portion formed between the film and the press contact feed member; and a fixing control portion providing power to the radiant heat source so as to provide the heat ray at least when the paper carrying the toner to be fixed is in pressing contact with the film.

2. A fixing device as claimed in claim 1, wherein said film heat ray absorbing property is provided by a black or nearly black coloration of the film.

3. A fixing device as claimed in claim 2, wherein the film is formed having a thickness in a range from several microns to about 1 mm.

4. a fixing device as claimed in claim 1, further comprising:

a preliminary heating control portion providing a heat ray from said radiant heat source at a stand-by power level below a fixing power level for preliminarily heating the film to a standby temperature below a toner fixing temperature.

5. A fixing device as claimed in claim 1, wherein the hollow cylinder comprises a heat resistant material.

6. A fixing device as claimed in claim 5, wherein the hollow cylinder comprises quartz glass.

7. A fixing device as claimed in claim 6, wherein the hollow cylinder has a cylindrical wall thickness of about 3 mm and is capable of bearing a fixing pressure from said press contact feed member.

8. A fixing device as claimed in claim 1, wherein said heat ray concentrator comprises:

a reflecting plate that converges the heat ray to the area of the film and said hollow cylinder further encloses a sub-heater and sub-reflecting plate that will converge a sub-heat ray of the sub-heater to a separate area on the film.

9. a fixing device as claimed in claim 1, wherein the press contact feed member comprises a belt.

10. A fixing device which fixes toner carried on paper processed by an electrophotographic apparatus, comprising:

at least one radiant heat source providing heat ray;

a hollow cylinder arranged around the radiant source, said hollow cylinder being transparent to the heat ray;

a film covering an outer circumferential face of the hollow cylinder, said film having a heat ray absorbing property permitting the impinging heat ray transmitted by the cylinder to be absorbed to heat the film to a temperature sufficient to fix the toner;

a press contact feed member feeding the paper carrying the toner into pressing contact with the heated film during toner fixing by the heated film;

a fixing control portion providing power to the radiant heat source so as to provide the heat ray at least when the paper carrying the toner to be fixed is in pressing contact with the film; and a preliminary heating control portion providing the heat ray from said radiant heat source at a stand-by power level below a fixing power level for preliminarily heating the film to a standby temperature below a toner fixing temperature.

11. A fixing device as claimed in claim 10, wherein said film heat ray absorbing property is provided by a black or nearly black coloration of the film.

12. A fixing device as claimed in claim 11, wherein the film is formed having a thickness in a range from several microns to about 1 mm.

13. A fixing device as claimed in claim 10, further comprising:

a heat ray concentrator operatively associated with the radiant heat source and surrounded by said hollow cylinder so as to concentrate the heat ray on a first area of the film near to a nipping portion formed between the film and the press contact feed member.

14. A fixing device as claimed in claim 13, wherein said heat ray concentrator comprises:

a reflecting plate that converges the heat ray to the area of the film and said hollow cylinder further encloses a sub-heater and sub-reflecting plate that will converge a sub-heat ray of the sub-heater to a separate area on the film.

15. A fixing device as claimed in claim 10, wherein the hollow cylinder comprises a heat resistant material.

16. A fixing device as claimed in claim 15, wherein the hollow cylinder comprises quartz glass.

17. A fixing device as claimed in claim 16, wherein the hollow cylinder has a cylindrical wall thickness of about 3 mm and is capable of bearing a fixing pressure from said press contact feed member.

18. A fixing device as claimed in claim 10, wherein the press contact feed member comprises a belt.

19. An image forming apparatus in which plural kinds of printing paper sheets are available and in which one kind of printing paper sheet is selected for feeding by a selective feeding arrangement, comprising:

a toner transfer station transferring toner to the selected printing paper sheet;

a fixing device fixing toner transferred to the selected printing paper sheet;

a condition generator generating one or more conditions in accordance with the selected printing paper sheet being fed by said selective feeding arrangement; and an operation control device controlling at least a fixing temperature of said fixing device in accordance with the generated one or more conditions;

said fixing device further comprising, a hollow cylinder, a heater radiating a heat ray arranged within the hollow cylinder, said hollow cylinder having walls transparent to the heat ray, a film formed on an outer circumferential face of the hollow cylinder and having a heat ray absorbing characteristic providing for heat ray absorption of an impinging heat ray radiated by said heater to heat the film to a temperature sufficient to fix the toner, a press contact feeding member feeding the selected printing paper sheet in a state in which the selected printing paper sheet comes into press contact with said film on said hollow cylinder, and a heat ray concentrator operatively associated with the heater and surrounded by said hollow cylinder so as to concentrate the heat ray on a first area of the film near to a nipping portion formed between the film and the press contact feeding member.

20. An image forming apparatus as claimed in claim 19, wherein said operation control device comprises means for controlling a starting time of fixing dependent upon the one or more conditions from the condition generator.

21. An image forming apparatus as claimed in claim 19, wherein said operation control device comprises means for controlling at least the fixing temperature by selectively switching electric power to the heater of the fixing device at a time dependent upon the one or more conditions from the condition generator.

22. An image forming apparatus as claimed in claim 19, wherein said condition generator generates at least one of a size condition, a conveying direction condition, and a thickness condition of the selected printing paper sheet.

23. An image forming apparatus as claimed in claim 19, wherein the hollow cylinder comprises of a material having resistance to heat provided by said film after absorption of said heat ray.

24. An image forming apparatus as claimed in claim 23, wherein the hollow cylinder comprises quartz glass.

25. An image forming apparatus as claimed in claim 24, wherein the hollow cylinder has a thickness of about 3 mm and is capable of bearing a fixing pressure from said press contact feeding member.

26. An image forming apparatus as claimed in claim 19, wherein the film comprises a material having properties ensuring easy release of fixed toner and resistance to the heat generated by the absorption of the heat ray, said film further being black or nearly black in color to maximize heat ray absorption and having a thickness of from several microns to about 1 mm to further insure a quick heating response.

27. An image forming apparatus as claimed in claim 19, wherein said fixing device further comprises:

a heat ray reflecting and converging plate arranged in said hollow cylinder opposed to said heater as said heat concentrator, and a sub-heater providing a sub-heat ray and an opposed sub-reflecting and converging second plate also arranged in said hollow cylinder, said second plate converging a reflected sub-heat ray to an area of the film separate from the first area.

28. An image forming apparatus as claimed in claim 19, wherein the press contact feeding member comprises a belt.

29. An image forming apparatus in which plural kinds of printing paper sheets are available and in which one available kind of printing paper sheet is selected for feeding by a selective feeding arrangement, said image forming apparatus further comprising:

a toner transfer station transferring toner to the selected printing paper sheet;

a fixing device fixing toner transferred to the selected printing paper sheet;

a condition generator generating one or more conditions in accordance with the selected printing paper sheet being fed by said selective feeding arrangement; and an operation control device controlling at least a fixing temperature of said fixing device and a stand-by temperature below said fixing temperature for a preliminarily heating of the film in accordance with the generated one or more conditions;

said fixing device further comprising, a hollow cylinder, a heater radiating a heat ray arranged within the hollow cylinder, said hollow cylinder having walls transparent to the heat ray, a film formed on an outer circumferential face of the hollow cylinder and having a heat ray absorbing characteristic providing for heat ray absorption of an impinging heat ray radiated by said heater to heat the film to a temperature sufficient to fix the toner, and a press contact feeding member feeding the selected printing paper sheet in a state in which the selected printing paper sheet comes into press contact with said film on said hollow cylinder.

30. An image forming apparatus as claimed in claim 29, wherein said operation control device comprises means for controlling a starting time of fixing dependent upon the one or more conditions from the condition generator.

31. An image forming apparatus as claimed in claim 29, wherein said operation control device comprises means for controlling at least the fixing temperature by selectively switching electric power to the heater of the fixing device at a time dependent upon the one or more conditions from the condition generator.

32. An image forming apparatus as claimed in claim 29, wherein said condition generator generates at least one of a size condition, a conveying direction condition, and a thickness condition of the selected printing paper sheet.

33. An image forming apparatus as claimed in claim 29, wherein the hollow cylinder comprises of a material having resistance to heat provided by said film after absorption of said heat ray.

34. An image forming apparatus as claimed in claim 33, wherein the hollow cylinder comprises quartz glass.

35. An image forming apparatus as claimed in claim 34, wherein the hollow cylinder has a thickness of about 3 mm and is capable of bearing a fixing pressure from said press contact feeding member.

36. An image forming apparatus as claimed in claim 29, wherein the film comprises a material having properties ensuring easy release of fixed toner and resistance to heat generated by the film absorption of the heat ray, said film further being black or nearly black in color to maximize heat ray absorption and having a thickness of from several microns to about 1 mm to further insure a quick heating response.

37. An image forming apparatus as claimed in claim 29, wherein said fixing device further comprises:

a heat ray reflecting and converging plate also arranged within said hollow cylinder and opposed to said heater, said plate converging a reflected heat ray from the heater to a particular area of the film, and a sub-heater providing a sub-heat ray and an opposed sub-reflecting and converging second plate also arranged in said hollow cylinder, said second plate converging a reflected sub-heat ray to an area of the film separate from the particular area.

38. An image forming apparatus as claimed in claim 29, wherein the press contact feeding member comprises a belt.

* * * * *